US008011669B2

(12) United States Patent
Sakata et al.

(10) Patent No.: US 8,011,669 B2
(45) Date of Patent: Sep. 6, 2011

(54) VALVE STEM SEAL WITH GAS RELIEF FEATURES

(75) Inventors: David Sakata, Livonia, MI (US); Tigree Milam Butcher, Cleveland, CA (US)

(73) Assignee: Freudenberg-NOK General Partnership, Plymouth, MI (US)

( * ) Notice: Subject to any disclaimer, the term of this patent is extended or adjusted under 35 U.S.C. 154(b) by 323 days.

(21) Appl. No.: 11/951,373

(22) Filed: Dec. 6, 2007

(65) Prior Publication Data

US 2009/0146382 A1 Jun. 11, 2009

(51) Int. Cl.
*F02F 11/00* (2006.01)

(52) U.S. Cl. ..... 277/502; 123/188.6

(58) Field of Classification Search ..... 123/188.6; 277/502, 577, 552

See application file for complete search history.

(56) References Cited

U.S. PATENT DOCUMENTS

| | | | | | |
|---|---|---|---|---|---|
| 3,605,706 | A | * | 9/1971 | Bush | 123/90.37 |
| 4,106,781 | A | * | 8/1978 | Benjamin et al. | 277/353 |
| 4,317,436 | A | | 3/1982 | Barnhart et al. | |
| 4,421,326 | A | * | 12/1983 | Drygalski | 277/552 |
| 4,508,020 | A | * | 4/1985 | Szcupak | 277/353 |
| 4,531,483 | A | | 7/1985 | Vossieck et al. | |
| 4,811,704 | A | | 3/1989 | Boehmer et al. | |
| 4,947,811 | A | | 8/1990 | Binford | |
| RE33,715 | E | * | 10/1991 | Miura | 188/322.17 |
| 5,167,419 | A | * | 12/1992 | Robertson | 277/552 |
| 5,174,256 | A | | 12/1992 | Binford | |
| 5,237,971 | A | | 8/1993 | Worsley | |
| 5,553,869 | A | | 9/1996 | Stamback | |
| 6,202,616 | B1 | | 3/2001 | Gracyalny | |
| 6,209,504 | B1 | | 4/2001 | Hegemier et al. | |
| 6,230,679 | B1 | | 5/2001 | Hegernier et al. | |
| 6,290,235 | B1 | * | 9/2001 | Albertson | 277/510 |
| 6,394,463 | B1 | * | 5/2002 | Otani | 277/502 |
| 6,450,143 | B1 | | 9/2002 | Hegemier et al. | |
| 6,497,226 | B2 | * | 12/2002 | Bircann et al. | 123/568.11 |
| 6,571,761 | B1 | | 6/2003 | Leimer | |
| 6,609,700 | B2 | | 8/2003 | Leimer | |
| 6,679,502 | B1 | | 1/2004 | Leimer | |
| 6,702,293 | B2 | * | 3/2004 | Endo et al. | 277/500 |
| 6,722,658 | B2 | * | 4/2004 | Siegrist et al. | 277/436 |
| 6,752,398 | B1 | | 6/2004 | McArthy | |
| 6,764,063 | B2 | | 7/2004 | McArthy et al. | |
| 6,764,079 | B1 | | 7/2004 | Hegemier et al. | |
| 6,820,876 | B2 | * | 11/2004 | Iwano | 277/635 |
| 6,877,719 | B2 | | 4/2005 | Heinl | |
| 6,901,902 | B1 | | 6/2005 | Butcher et al. | |
| 6,938,877 | B2 | * | 9/2005 | Mc Arthy et al. | 251/214 |
| 7,097,004 | B2 | * | 8/2006 | Barrett et al. | 188/72.4 |
| 2003/0160394 | A1 | | 8/2003 | Martelli | |
| 2007/0022997 | A1 | * | 2/2007 | Lantelme | 123/188.6 |

* cited by examiner

*Primary Examiner* — Shane Bomar
*Assistant Examiner* — Kipp Wallace
(74) *Attorney, Agent, or Firm* — Ronald W. Wangerow, Esq.; Harness, Dickey & Pierce, P.L.C.

(57) ABSTRACT

A valve stem seal can include an elastomeric component having a first portion for having a sealed engagement with a valve stem, a second portion for engaging a valve guide, and a pressure relief lip extending from the second portion. The first portion can be configured to extend away from or within the second portion, and the second portion can have a channel formed therein. The pressure relief lip can have a sealing configuration and a venting configuration. The venting configuration can allow excess exhaust gases to vent from a combustion chamber. After the venting of excess exhaust gases, the pressure relief lip can close to the sealing configuration to prevent oil from entering the combustion chamber.

12 Claims, 13 Drawing Sheets

VALVE STEM SEAL WITH GAS RELIEF FEATURES

FIELD

The present disclosure relates to valve stem seals, and, in particular, to valve stem seals for use in internal combustion engines.

BACKGROUND

The statements in this section merely provide background information related to the present disclosure and may not constitute prior art.

Internal combustion engines are known to employ valve stem seals to regulate oil to the valve guide and minimize oil from entering a combustion chamber. However, the weakness of the current art is that pressure from the combustion chamber and an exhaust port of an engine can affect the function of primary sealing lips of valve stem seals. Gas lips, which provide an additional seal, have been applied, but pressure acting on such a gas lip can cause the orientation of a primary sealing lip against a valve stem to change and result in improper function. Accordingly, it would be desirable to provide a valve stem seal that can relieve pressure while continuing to prevent excessive oil from entering the combustion chamber.

SUMMARY

In one form, the present disclosure provides a valve stem seal for an internal combustion engine. The valve stem seal can include an annular elastomeric body adapted to be disposed around a valve stem and a valve guide for the engine. The elastomeric body can have a first portion adapted to have a sealed engagement with the valve stem and a second portion adapted to extend around the valve guide. The elastomeric body can also include a connecting portion extending radially outwardly from the first portion to the second portion and a pressure relief lip extending from the second portion. The pressure relief lip can have a sealing configuration and a venting configuration. The sealing configuration can be adapted to close a passageway in fluid communication with a combustion chamber of the engine to a lubrication chamber of the engine. The venting configuration can be adapted to open the passageway to the lubrication chamber. The pressure relief lip can be operable to open to the venting configuration at a predetermined pressure within the passageway and the combustion chamber to allow excess exhaust gases to vent from the passageway and the combustion chamber. Furthermore, the pressure relief lip can be operable to close to the sealing configuration after the venting of the excess exhaust gases to prevent fluid from the lubrication chamber from entering the passageway and the combustion chamber.

In another form, the present disclosure provides a valve stem seal assembly for an internal combustion engine. The engine can include a housing separating a lubrication chamber and a combustion chamber, a valve guide fixed in the housing, and a valve stem extending through the valve guide and housing between the lubrication chamber and the combustion chamber. The valve stem seal assembly can include an annular rigid body and an annular elastomeric body both adapted to be disposed around the valve guide and the valve stem. The elastomeric body can include a first portion adapted to have a sealed engagement with the valve stem and a second portion adapted to extend around the valve guide. The elastomeric body can also include a connecting portion extending radially outwardly from the first portion to the second portion and a pressure relief lip extending from the second portion. The pressure relief lip can have a sealing configuration and a venting configuration. The sealing configuration can be adapted to close a passageway in fluid communication with the combustion chamber to the lubrication chamber. The venting configuration can be adapted to open the passageway to the lubrication chamber. The pressure relief lip can be operable to open to the venting configuration at a predetermined pressure within the passageway and the combustion chamber to allow excess exhaust gases to vent from the passageway and the combustion chamber. Furthermore, the pressure relief lip can be operable to close to the sealing configuration after the venting of the excess exhaust gases to prevent fluid from the lubrication chamber from entering the passageway and the combustion chamber.

In another form, the present disclosure provides another valve stem seal assembly for an internal combustion engine. The valve stem seal assembly can including an annular elastomeric body and an annular rigid body. The elastomeric body can be adapted to be disposed around a valve guide and a valve stem of the engine. The elastomeric body can include a first portion adapted to have a sealed engagement with the valve stem, a second portion adapted to have a sealed engagement with the valve guide, and a connecting portion extending radially outwardly from a top part of the first portion to the second portion. The second portion can extend around the first portion. The rigid body can be disposed around the elastomeric body and can include an inside surface configured to engage an outside surface of the elastomeric body. The rigid body can be operable to maintain a position of the elastomeric body.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
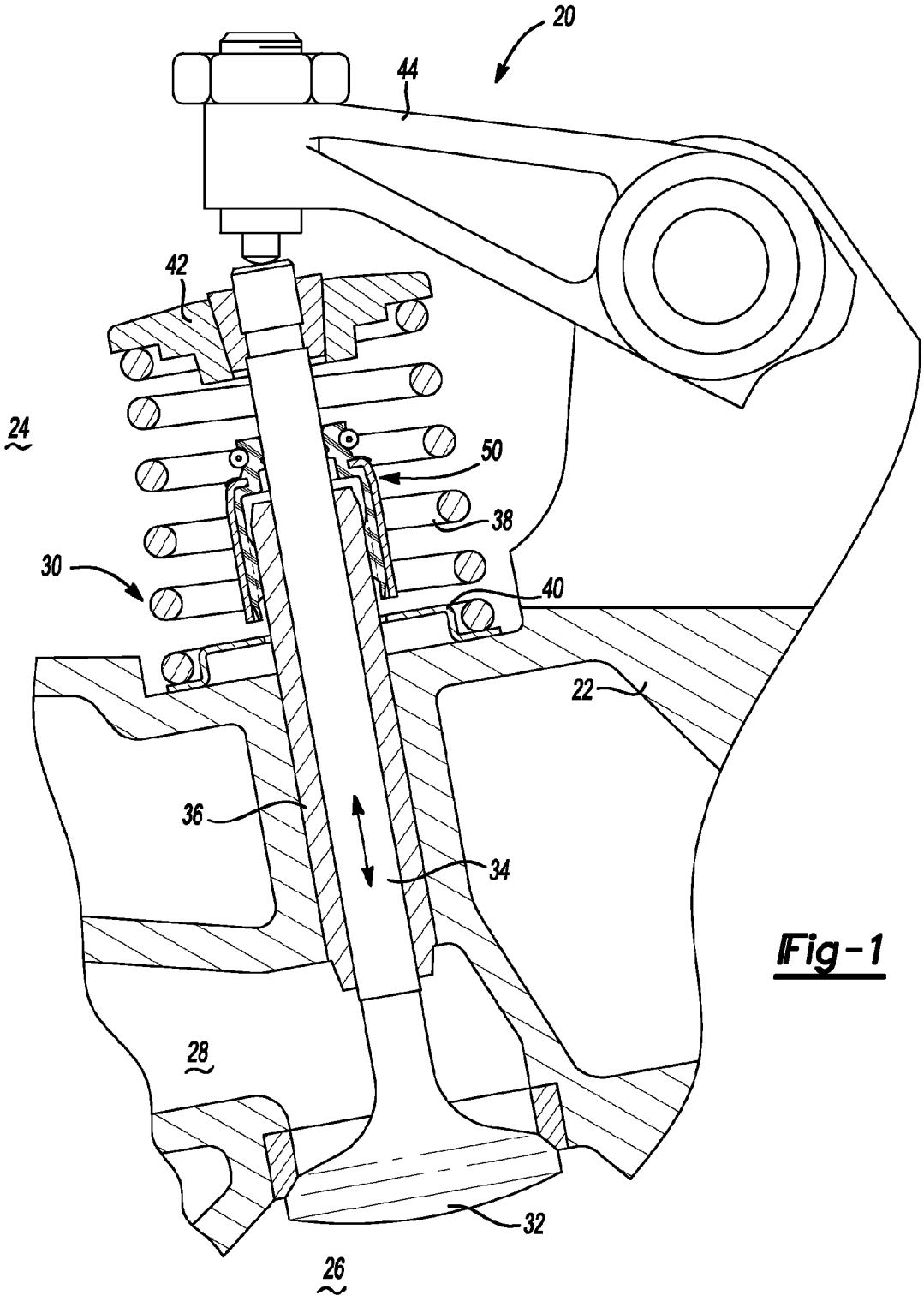
FIG. 1 is a cross-sectional view of a portion of an internal combustion engine including a valve stem seal assembly according to the principles of the present disclosure.

The following description is merely exemplary in nature and is not intended to limit the present disclosure, application, or uses. It should be understood that throughout the drawings, corresponding reference numerals indicate like or corresponding parts and features. For example, like elements may be referred to by the reference numerals 15, 115, and 215. Additionally, as used herein, the terms "axial" or "axially" refer to a direction substantially parallel to an axis of a shaft or cylindrical body according to the principles of the present disclosure. Furthermore, as used herein, the terms "radial" and "radially" refer to directions substantially perpendicular to an axis of a shaft or cylindrical body according to the principles of the present disclosure.

According to the principles of the present disclosure, a valve stem seal can include an elastomeric component having a first portion for having a sealed engagement with a valve stem, a second portion for engaging a valve guide, and a pressure relief lip extending from the second portion. The pressure relief lip can have a sealing configuration and a venting configuration. The venting configuration can allow excess exhaust gases to vent from a combustion chamber. After the venting of excess exhaust gases, the pressure relief lip can close to the sealing configuration to prevent oil and/or other fluids from entering the combustion chamber.

Referring to FIG. 1, a portion of an engine 20 is shown. According to the principles of the present disclosure, engine 20 can be an internal combustion engine and can have a variety of forms and configurations, including but not limited to an overhead valve configuration and overhead camshaft configuration. Engine 20 can have a variety of components including a housing 22. Housing 22 can define a lubrication or oil chamber 24 and a combustion chamber 26. Housing 22 can further define an inlet or exhaust chamber 28 for combustion chamber 26. It should be understood that further reference to inlet chamber 28 herein as "inlet" should also be considered as equally pertaining to the exhaust chamber as well. Engine 20 can further include a valve assembly 30 disposed between oil chamber 24 and combustion chamber 26. As the general function and operation of engine 20 and the components thereof are well known to those of ordinary skill in the art, they will not be further described herein.

Valve assembly 30 can have a variety of components. Valve assembly 30 can include a valve head 32 disposed within combustion chamber 26. Valve head 32 can be connected to a valve stem 34, which can be disposed within a valve guide 36. Valve stem 34 and valve guide 36 can extend through housing 22 between oil chamber 24 and combustion chamber 26. Valve assembly 30 can further include a valve spring 38 within oil chamber 24. Valve spring 38 can be disposed between a valve spring seat 40 and a valve spring retainer 42. Valve spring seat 40 can be coupled to housing 22, and valve spring retainer can be coupled to valve stem 34. Valve assembly 30 can further include an actuation mechanism 44 disposed within oil chamber 24. Actuation mechanism 44 can vary according to the form of engine 20. Additionally, valve assembly 30 can include a valve stem seal assembly 50 disposed around valve stem 34 and valve guide 36 within oil chamber 24.

Valve assembly 30 can be selectively operable to control fluid communication between combustion chamber 26 and inlet chamber 28. In particular, valve head 32 can be positioned to close combustion chamber 26 to fluid communication with inlet chamber 28 or to open combustion chamber 26 to fluid communication with inlet chamber 28. The position of valve head 32 can correspond to the position of valve stem 34. Valve guide 36 can be coupled to housing 22, and valve stem 34 can be operable to move in an axial direction relative to valve guide 36. Valve spring 38 can bias valve stem 34 and valve head 32 into a home position. As shown in FIG. 1, the home position can correspond to valve head 32 closing combustion chamber 26 to fluid communication with inlet chamber 28. Furthermore, actuation mechanism 44 can be selectively operated to move valve stem 34 and valve head 32 from the home position and thereby open combustion chamber 26 to fluid communication with inlet chamber 28. During operation of valve assembly 30, valve stem seal assembly 50 can provide a seal around valve stem 34 and valve guide 36 and can regulate oil and/or other fluids from oil chamber 24 from entering combustion chamber 26.

During operation of engine 20, excess exhaust gases can build up in combustion chamber 26 or back flow from chamber 28. These excess exhaust gases can travel between valve guide 36 and valve stem 34 and can exert pressure on valve stem seal assembly 50. According to the principles of the present disclosure, valve stem seal assembly 50 can include venting features so that, at a predetermined pressure, excess exhaust gases can be vented. Such venting can prevent a decrease in performance of valve stem seal assembly 50 and/or failure of valve stem seal assembly 50 such as blow-off. The venting features of valve stem seal assembly 50 are described in further detail below.

Figure 2B:
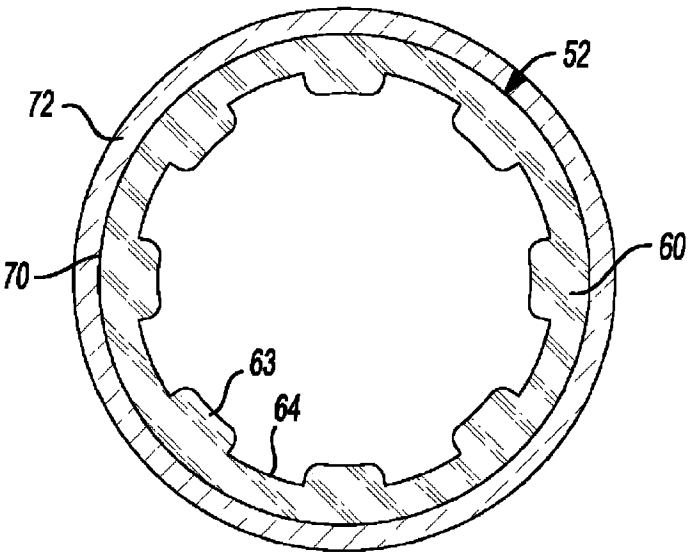
FIG. 2B is a cross-sectional view of the seal component of FIG. 2A along line 2B shown in FIG. 2A.
Figure 2A:
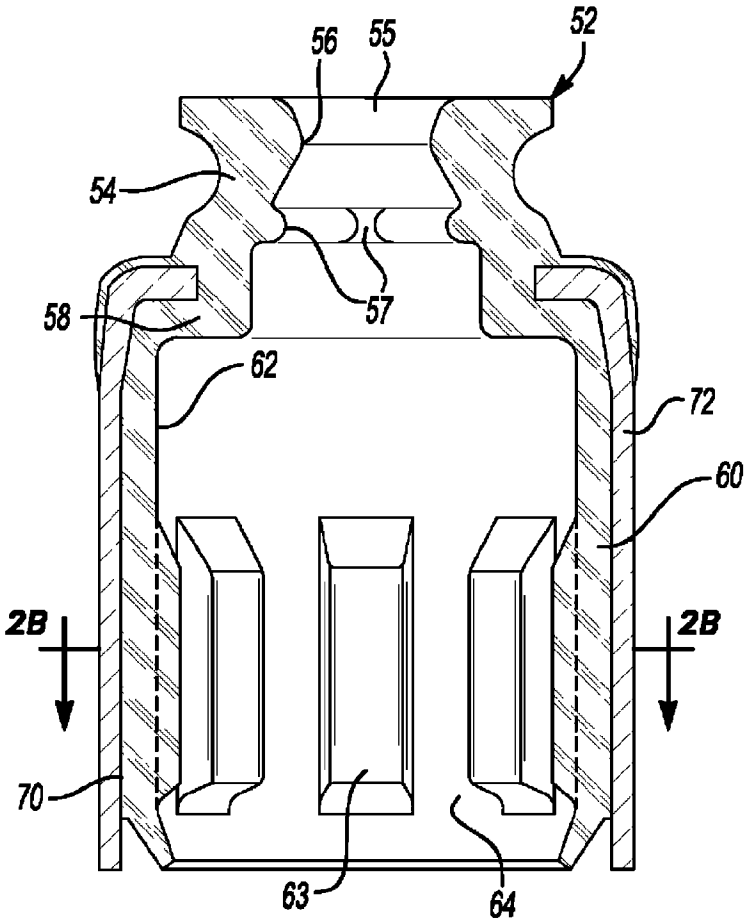
FIG. 2A is a cross-sectional view of a seal component of a valve stem seal assembly according to the principles of the present disclosure.
Figure 3B:
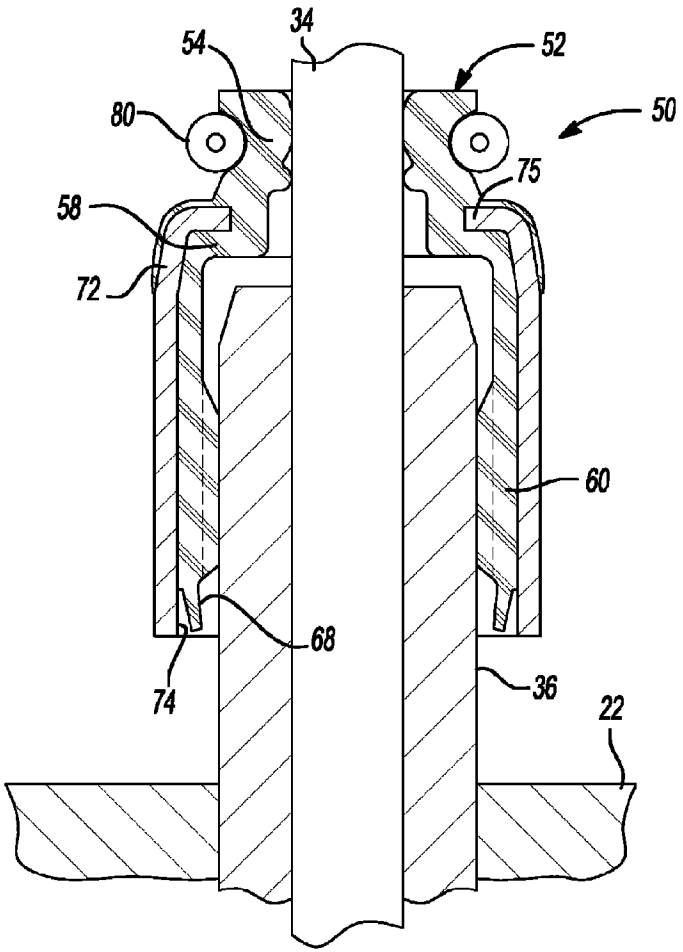
FIG. 3B is a cross-sectional view of the valve stem seal assembly of FIG. 3A including the pressure relief lip in a venting configuration according to the principles of the present disclosure.
Figure 3A:
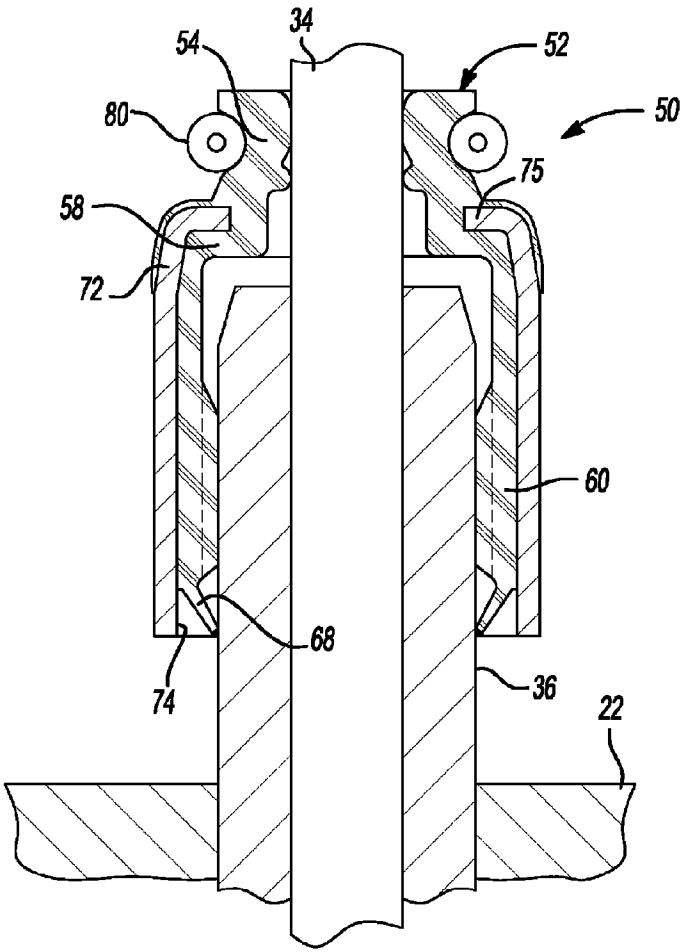
FIG. 3A is a cross-sectional view of the valve stem seal assembly of FIG. 1 including a pressure relief lip in a sealing configuration according to the principles of the present disclosure.

Referring to FIGS. 2A and 2B, valve stem seal assembly 50 can include a seal component 52. Seal component 52 can be a single, unitary body having a generally annular shape. Seal component 52 can include a first or top portion 54. Top portion 54 can be configured to be disposed around and have a sealed engagement with valve stem 34. For example, top portion 54 can have an inside surface 55 defining sealing feature 56 and support features 57 for directly engaging valve stem 34 (FIGS. 3A and 3B). In particular, four support features 57 can be disposed around inside surface 55. Additionally, an intermediate or connecting portion 58 can extend radially outwardly from top portion 54.

Seal component 52 can also include a second or bottom portion 60. Bottom portion 60 can extend from connecting portion 58 in an axial direction away from top portion 54. Bottom portion 60 can be configured to extend around and have a selectively sealed engagement with valve guide 36. To provide for the selectively sealed engagement with valve guide 36, bottom portion 60 can have an inside surface 62 defining at least one protrusion 63 and channel 64. For example, a plurality of protrusions 63 and channels 64 can be provided around the inside surface 62, as shown in the Figures. Protrusions 63 can be sized to engage with valve guide 36 and can provide for a press fit between bottom portion 60 and valve guide 36. According to the principles of the present disclosure, channels 64 can provide for gas communication between bottom portion 60 and valve guide 36 and, thus, can form part of a passageway in gas communication with combustion chamber 26, as described in further detail below.

Bottom portion 60 can also have a pressure relief lip 68 extending therefrom. Pressure relief lip 68 can extend from bottom portion 60 and contact valve guide 36 (FIG. 3A). As described in further detail below, pressure relief lip 68 can have a selectively sealed engagement with valve guide 36. Bottom portion 60 can also have an outside surface 70. Additionally, seal component 52 can be made of a variety of elastomeric materials including but not limited to fluoroelastomers, polyacrylics, and natural rubber.

Valve stem seal assembly 50 can also include a rigid component 72 (FIGS. 3A and 3B). Rigid component 72 can have a generally annular shape and can extend around seal component 52. Rigid component 72 can include an inside surface 74 configured to engage with outside surface 70 of bottom portion 60 of seal component 52 and a radially inwardly extending flange portion 75 engaging intermediate portion 58. Rigid component 72 can be made of a variety of relatively rigid materials.

Additionally, valve stem seal assembly 50 can include a spring 80. Spring 80 can be disposed around top portion 54 of seal component 52. Spring 80 can exert an inward biasing force on top portion 54 to enhance the sealed engagement between seal component 52 and valve stem 34.

Referring to FIGS. 3A and 3B, valve stem seal assembly 50 can be disposed around valve stem 34 and valve guide 36. As noted above, top portion 54 of seal component 52 can have a sealed engagement with valve stem 34, and bottom portion 60 can engage valve guide 36. Furthermore, rigid component 72 can be disposed around seal component 52 and can help maintain the position of seal component 52.

Pressure relief lip 68 can have a sealing configuration, as shown in FIG. 3A. In the sealing configuration, pressure relief lip 68 can engage valve guide 36. The sealing configuration of pressure relief lip 68 can allow valve stem seal assembly 50 to prevent fluid communication between oil chamber 24 and combustion chamber 26.

Pressure relief lip 68 can also have a venting configuration, as shown in FIG. 3B. As noted above, excess exhaust gases from combustion chamber 26 or back flow from chamber 28 can exert pressure on valve stem seal assembly 50. At a predetermined pressure in combustion chamber 26 or chamber 28 and the passageway, excess exhaust gases can cause pressure relief lip 68 to open to the venting configuration. With pressure relief lip 68 in the venting configuration, excess exhaust gases can vent from combustion chamber 26 through the passageway including channels 64 and to oil chamber 24. When the pressure in combustion chamber 26 and the passageway is below the predetermined pressure, pressure relief lip 68 can return to the sealing configuration and, thus, prevent oil or other fluids from oil chamber 24 from entering combustion chamber 26. Thus, according to the principles of the present disclosure, valve stem seal assembly 50 can vent excess exhaust gases from combustion chamber 26 while maintaining a sealed engagement around valve stem 34 and thus preventing oil and/or other fluids from oil chamber 24 from entering combustion chamber 26.

Referring to FIGS. 4 to 20, additional embodiments of valve stem seal assemblies according to the principles of the present disclosure are shown. It will be understood that various embodiments of the present disclosure can incorporate similar components and features, and the descriptions of the components and features herein are not particular to a single embodiment and can apply to components and features in various embodiments.

Figure 4:
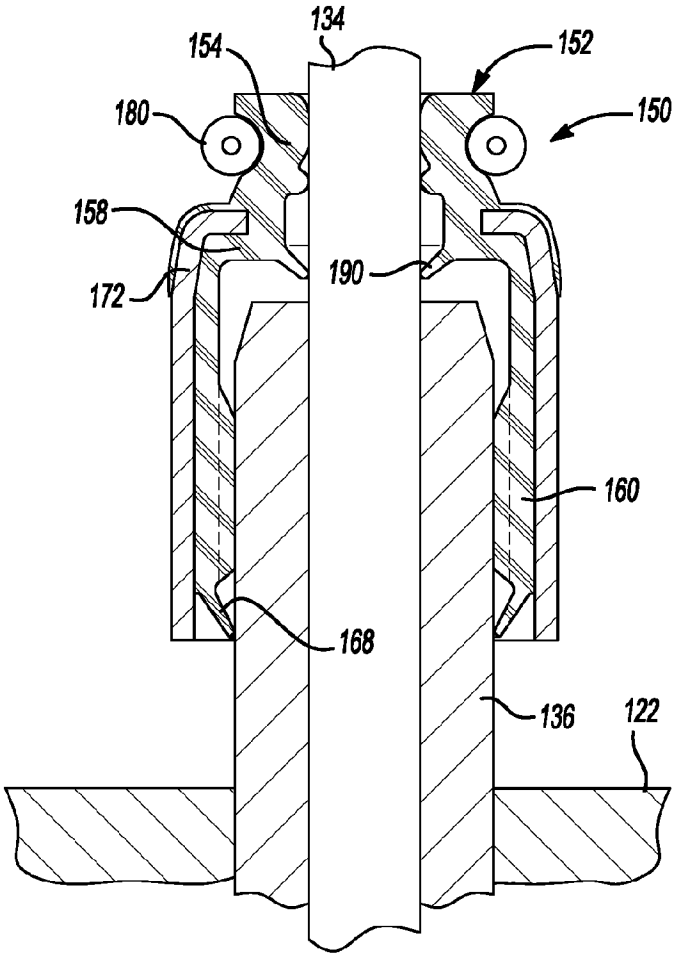
FIG. 4 is a cross-sectional view of another valve stem seal assembly according to the principles of the present disclosure.

Referring to FIG. 4, a valve stem seal assembly 150 is shown. Valve stem seal assembly 150 can include a seal component 152 which includes a gas lip 190. Gas lip 190 can provide an additional seal between seal component 152 and a valve stem 134. Gas lip 190 can also help direct excess exhaust gases toward a pressure relief lip 168. Otherwise, valve stem seal assembly 150 and seal component 152 can be substantially similar to valve stem seal assembly 50 and seal component 52 discussed above.

Figure 5:
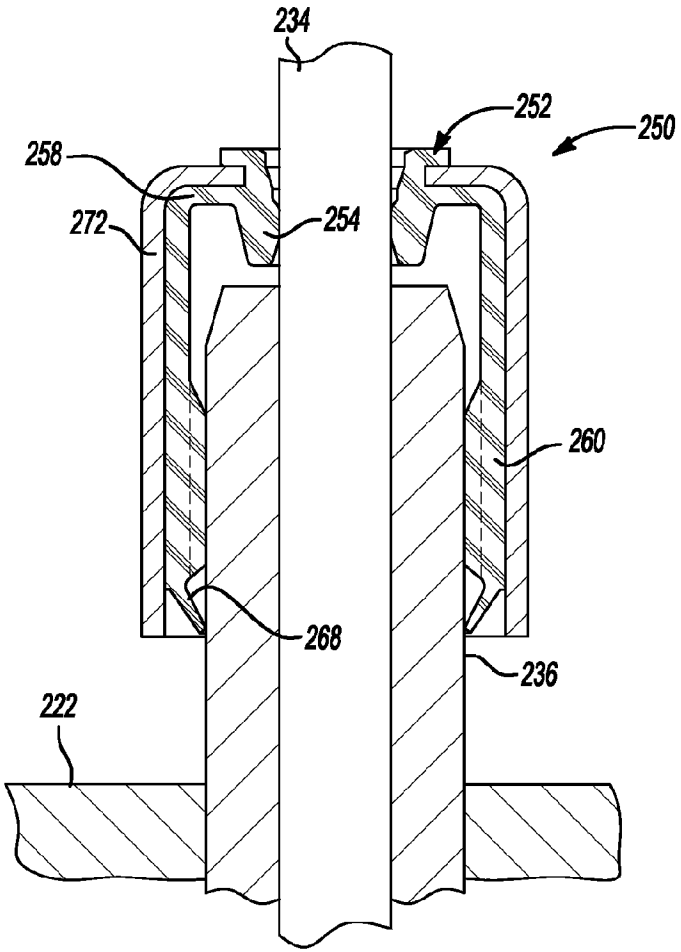
FIG. 5 is a cross-sectional view of another valve stem seal assembly according to the principles of the present disclosure.

Referring to FIG. 5, a valve stem seal assembly 250 can include a seal component 252 having an inverted top portion 254. Seal component 252 can further include a connecting portion 258 extending radially outwardly from top portion 254 and a bottom portion 260 extending axially from connecting portion 258. Due to the inverted configuration of top portion 254, bottom portion 260 can extend around top portion 254. Otherwise, bottom portion 260 can be substantially similar to bottom portion 60 discussed above. The configuration of top portion 254 can help guide excess exhaust gases toward a pressure relief lip 268. Furthermore, due to the configuration of top portion 254, pressure exerted on top portion 254 can enhance the sealed engagement of top portion 254 with a valve stem 234.

Figure 6B:
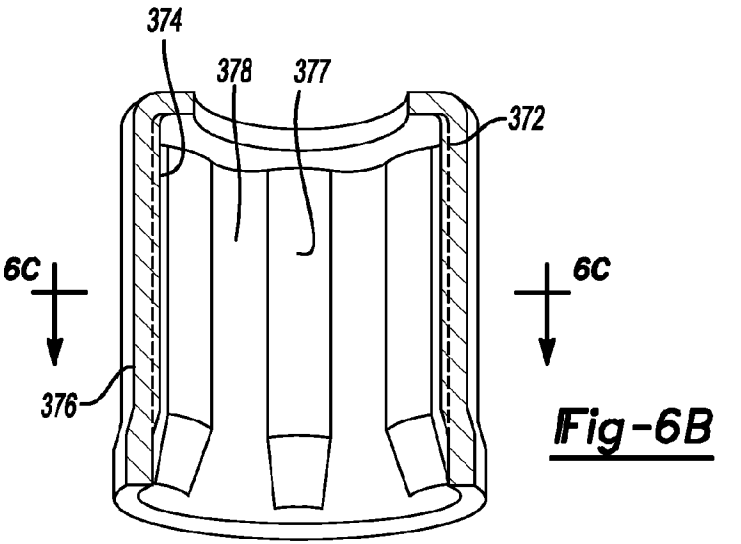
FIG. 6B is a cross-sectional view of a rigid component of the valve stem seal assembly of FIG. 6A.
Figure 6C:
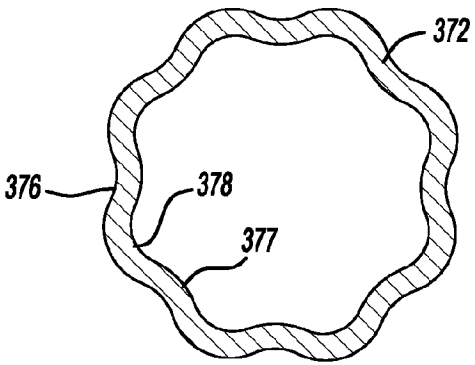
FIG. 6C is a cross-sectional view of the rigid component of FIG. 6B along the line 6C shown in FIG. 6B.
Figure 6A:
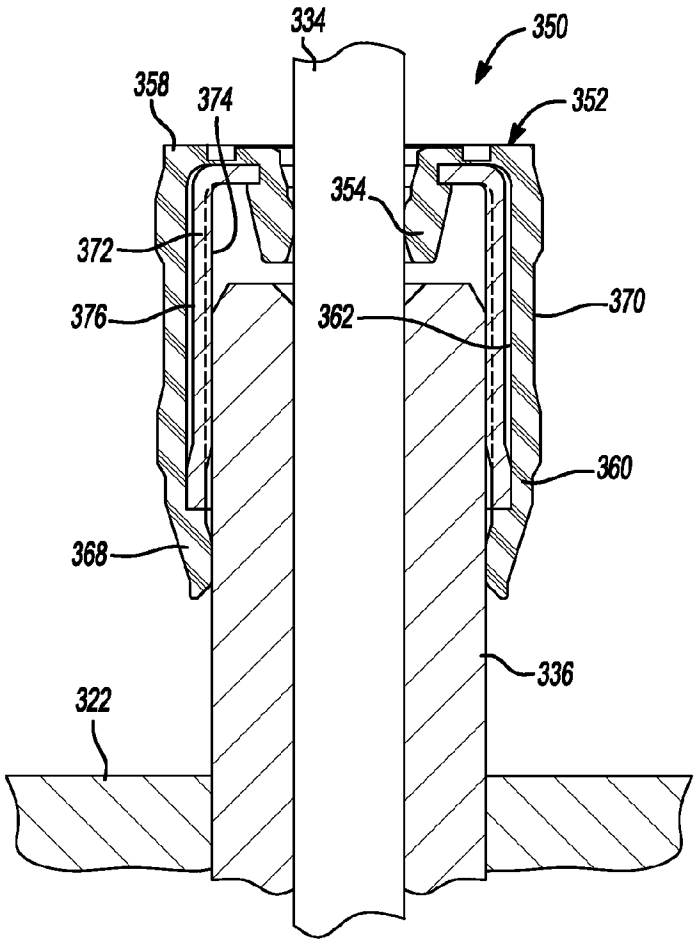
FIG. 6A is a cross-sectional view of another valve stem seal assembly according to the principles of the present disclosure.

Referring to FIGS. 6A-6C, a valve stem seal assembly 350 can include a seal component 352 and a rigid component 372. Rigid component 372 can be configured to engage valve guide 336 between seal component 352 and valve guide 336. In particular, rigid component 372 can have a press fit with valve guide 336. Furthermore, rigid component 372 can define an inner surface 374 and an outer surface 376. Inner surface 374 can include protrusions 377 and channels 378.

According to the principles of the present disclosure, channels 378 can provide for fluid communication between rigid component 372 and valve guide 336 and can function substantially similarly to channels 64 of seal component 52 discussed above. Additionally, seal component 352 can be disposed around rigid component 372 and can have a pressure relief lip 368 in contact with valve guide 336. Pressure relief lip 368 can be substantially similar to pressure relief lip 68 discussed above.

Figure 7:
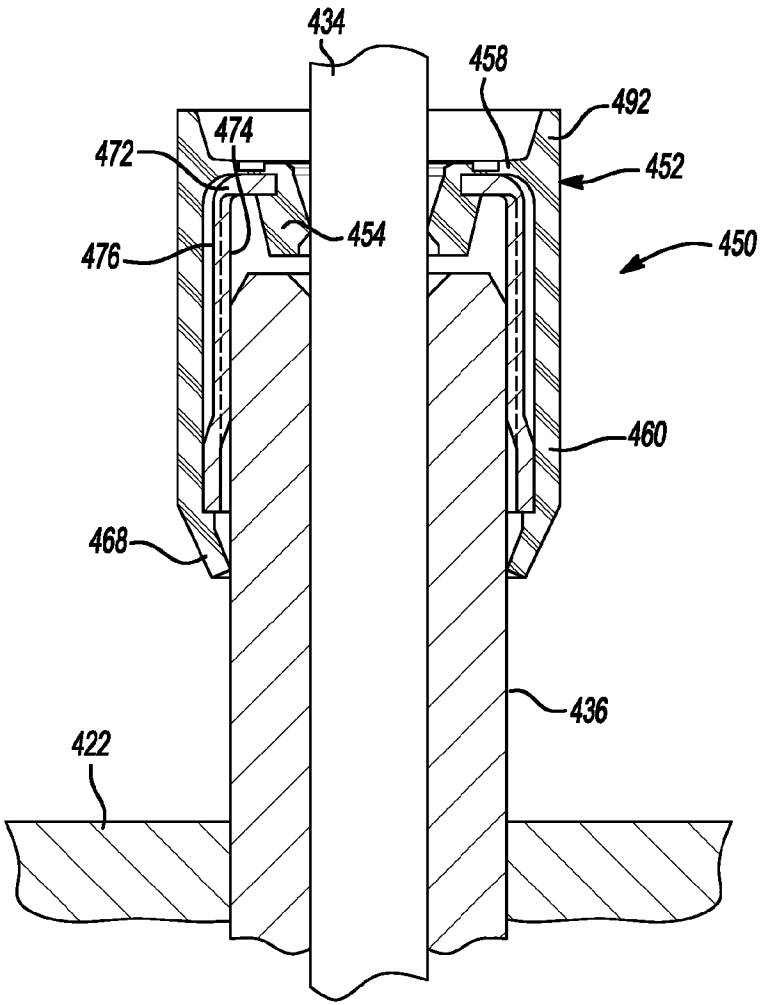
FIG. 7 is a cross-sectional view of another valve stem seal assembly according to the principles of the present disclosure.

Referring to FIG. 7, a valve stem seal assembly 450 can include a seal component 452 and a rigid component 472. Seal and rigid components 452, 472 can include all of the features of seal and rigid components 352, 372 discussed above. Additionally, seal component 452 can include an oil lip 492. Oil lip 492 can extend from a connecting portion 458 axially away from a bottom portion 460. Oil lip 492 can define a pool or lubrication fluid trap around valve stem 434 for oil or other lubricant to gather and be available to lubricate valve stem 434 during operation.

Figure 8:
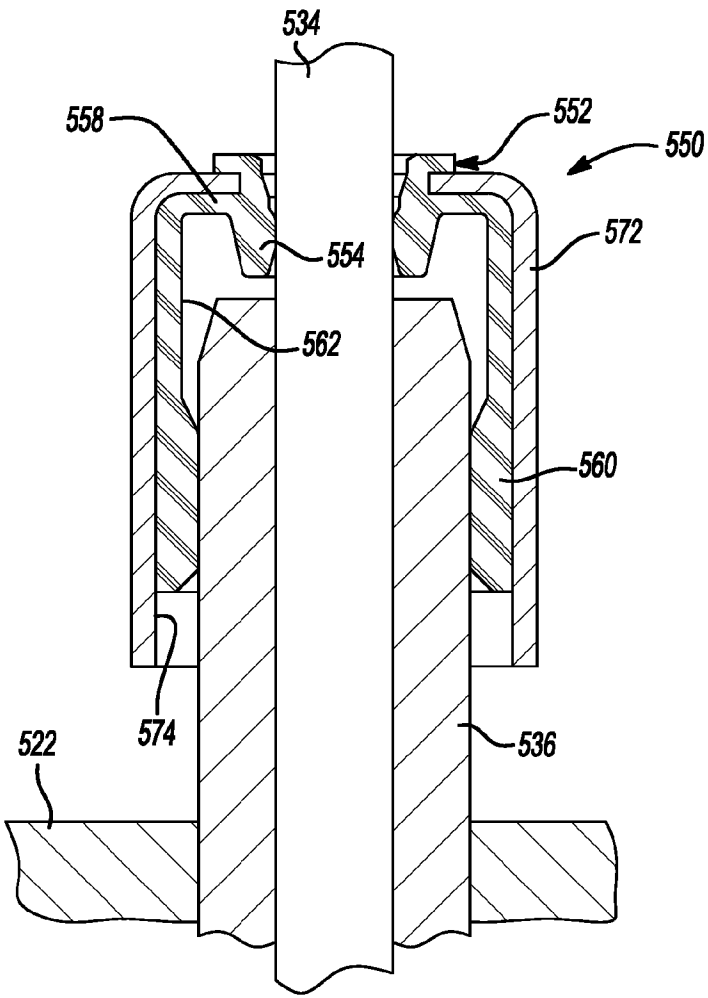
FIG. 8 is another cross-sectional view of a valve stem seal assembly according to the principles of the present disclosure.

Referring to FIG. 8, a valve stem seal assembly 550 according to the principles of the present disclosure which does not include venting features is shown. Valve stem seal assembly 550 can include a seal component 552 having an inverted top portion 554. The configuration of top portion 554 can enhance the sealed engagement between top portion 554 and a valve stem 534 such as is discussed above with regard to seal component 252 and top portion 254.

Figure 9:
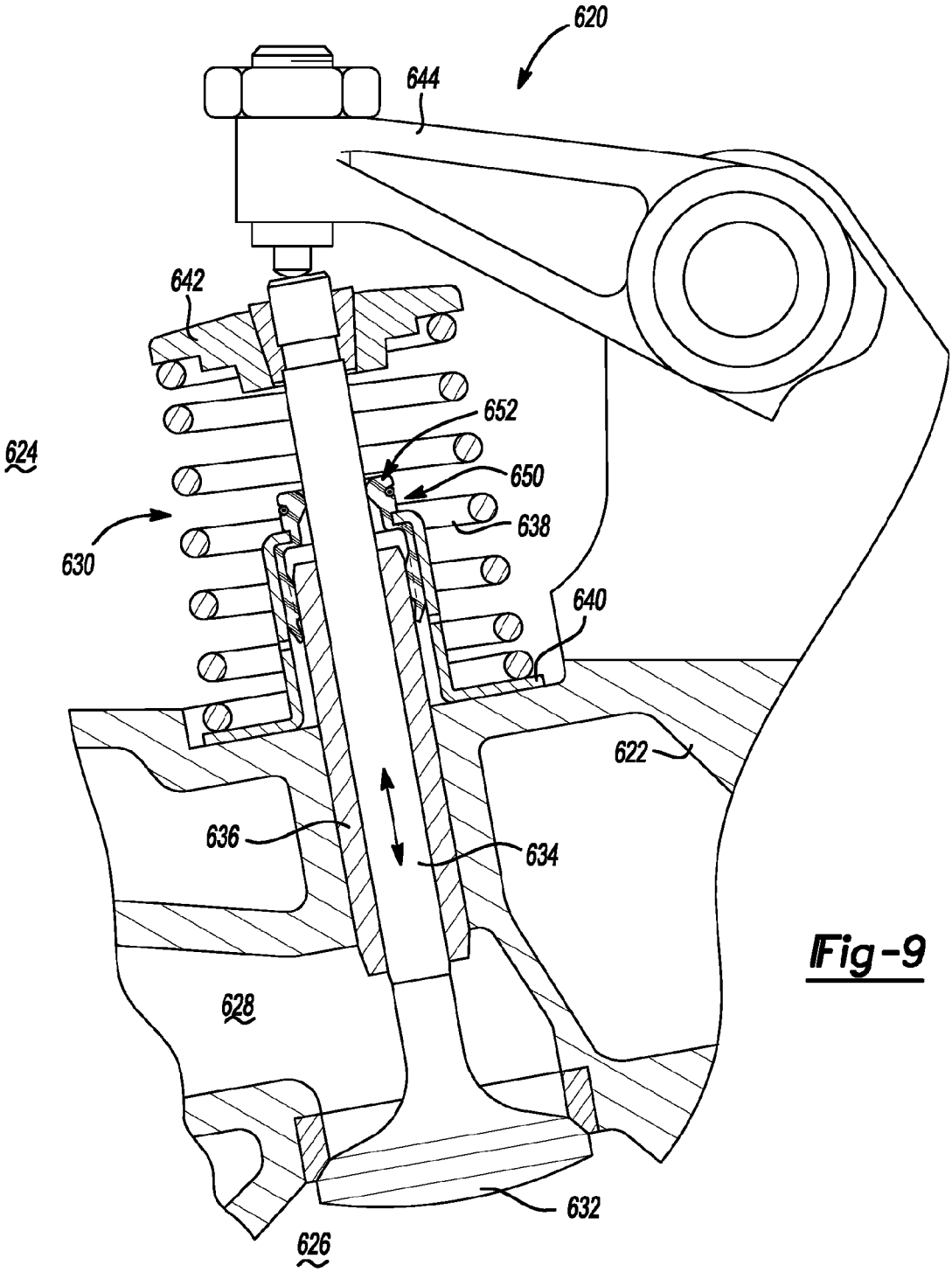
FIG. 9 is a cross-sectional view of a portion of another internal combustion engine including another valve stem seal assembly according to the principles of the present disclosure.

Referring to FIG. 9, an alternate configuration of an engine 620 is shown. Engine 620 can have many components that are substantially similar to engine 20 discussed above. However, engine 620 can include a valve spring seat 640 which can extend upward and form a part of a valve stem seal assembly 650.

Figure 10:
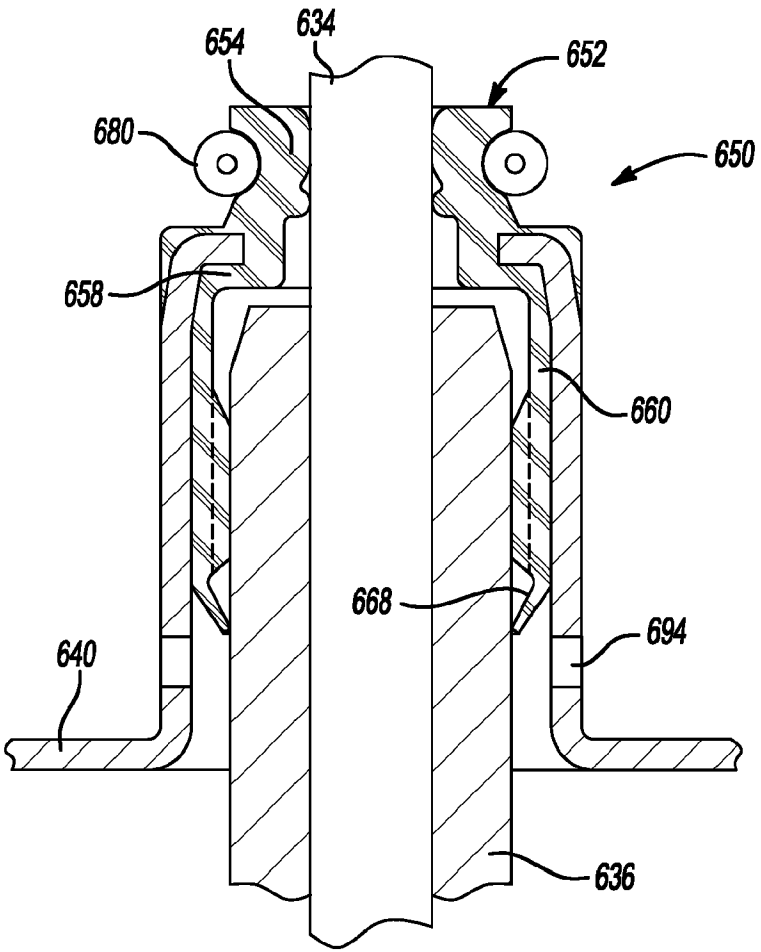
FIG. 10 is a cross-sectional view of the valve stem seal assembly of FIG. 9.

Referring to FIG. 10, a valve stem seal assembly 650 can include a seal component 652 substantially similar to seal component 52 discussed above. Valve stem seal assembly 650 can also include valve spring seat 640. Valve spring seat 640 can be disposed around and can engage with seal component 652. Valve spring seat 640 can help to maintain the position of seal component 652 similar to rigid component 72 discussed above. Furthermore, valve spring seat 640 can include apertures 694 proximate a pressure relief lip 668. Apertures 694 can provide for venting of excess exhaust gases.

Figure 11:
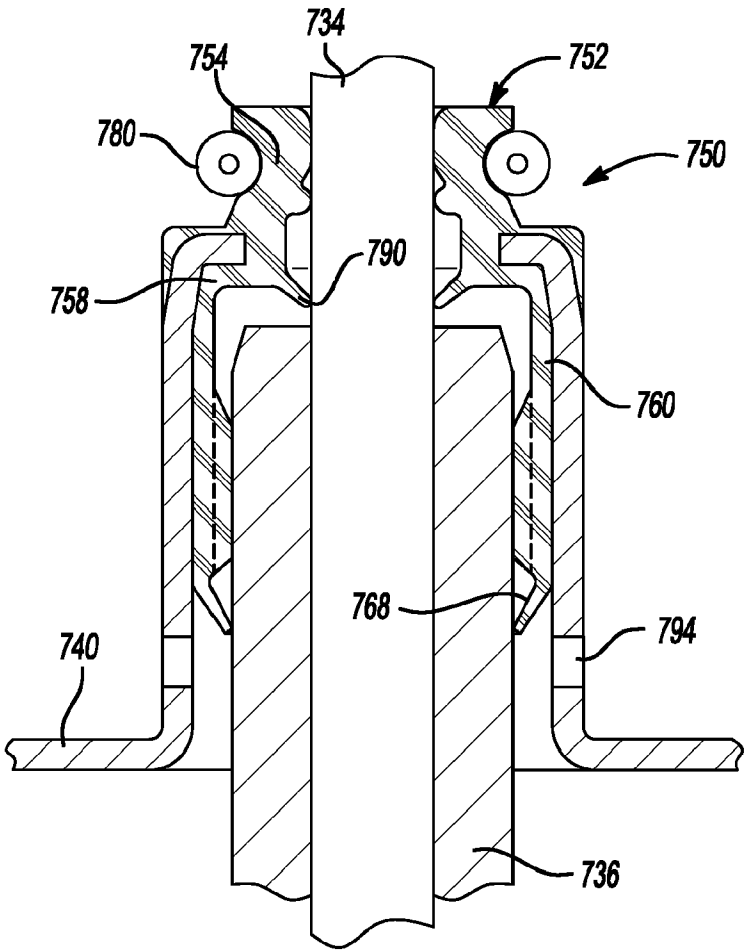
FIG. 11 is a cross-sectional view of another valve stem seal assembly according to the principles of the present disclosure.

Referring to FIG. 11, a valve stem seal assembly 750 can include a seal component 752 and a valve spring seat 740. Seal component 752 can be substantially similar to seal component 152 discussed above, and a valve spring seat 740 can be substantially similar to valve spring seat 640 discussed above.

Figure 12:
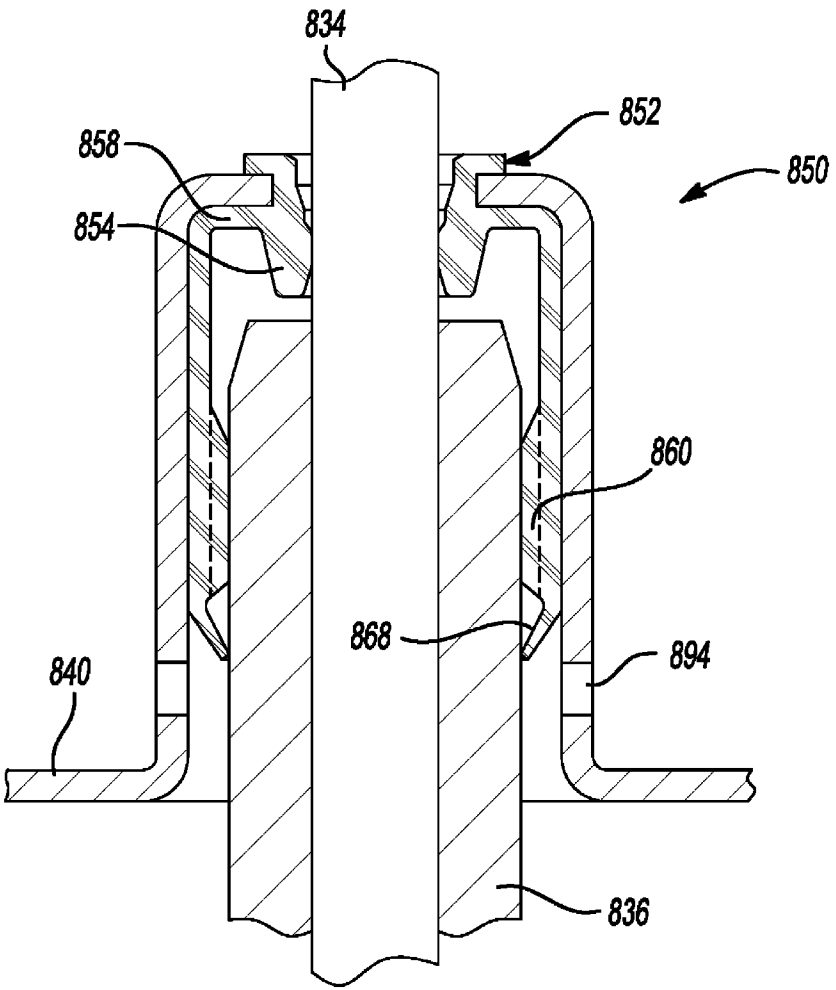
FIG. 12 is a cross-sectional view of another valve stem seal assembly according to the principles of the present disclosure.

Referring to FIG. 12, a valve stem seal assembly 850 can include a seal component 852 and a valve spring seat 840. Seal component 852 can be substantially similar to seal component 252 discussed above, and valve spring seat 840 can be substantially similar to valve spring seat 640 discussed above.

Figure 13:
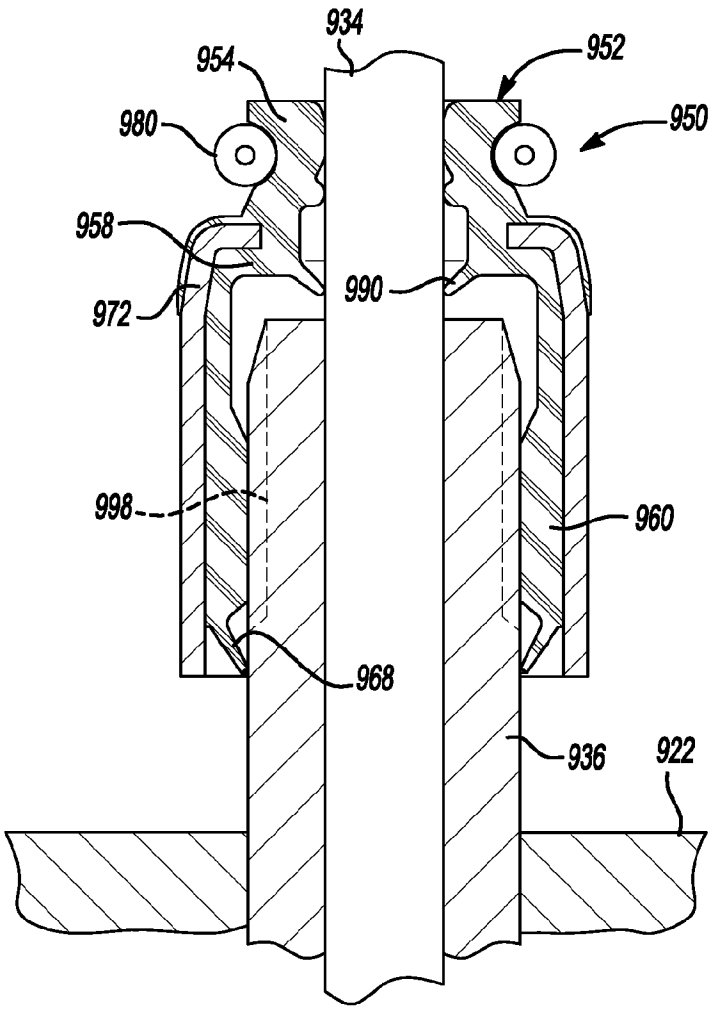
FIG. 13 is a cross-sectional view of another valve stem seal assembly according to the principles of the present disclosure.

Referring to FIG. 13, a valve stem seal assembly 950 can include a valve guide 936, a seal component 952, and a rigid component 972. Seal component 952 can be substantially similar to seal component 152 discussed above. However, seal component 952 includes a bottom portion 960 which does not have any protrusions or channels formed therein. Rigid component 972 can be substantially similar to rigid component 72 discussed above. Valve guide 936 can include at least one channel 998 formed therein. For example, as shown in FIG. 13, valve guide 936 can have a plurality of channels 998. With seal component 952 disposed around valve guide 936, channels 998 can provide for gas communication between bottom portion 960 and valve guide 936 and, thus, can form part of a passageway in gas communication with a combustion chamber as described above.

Figure 14:
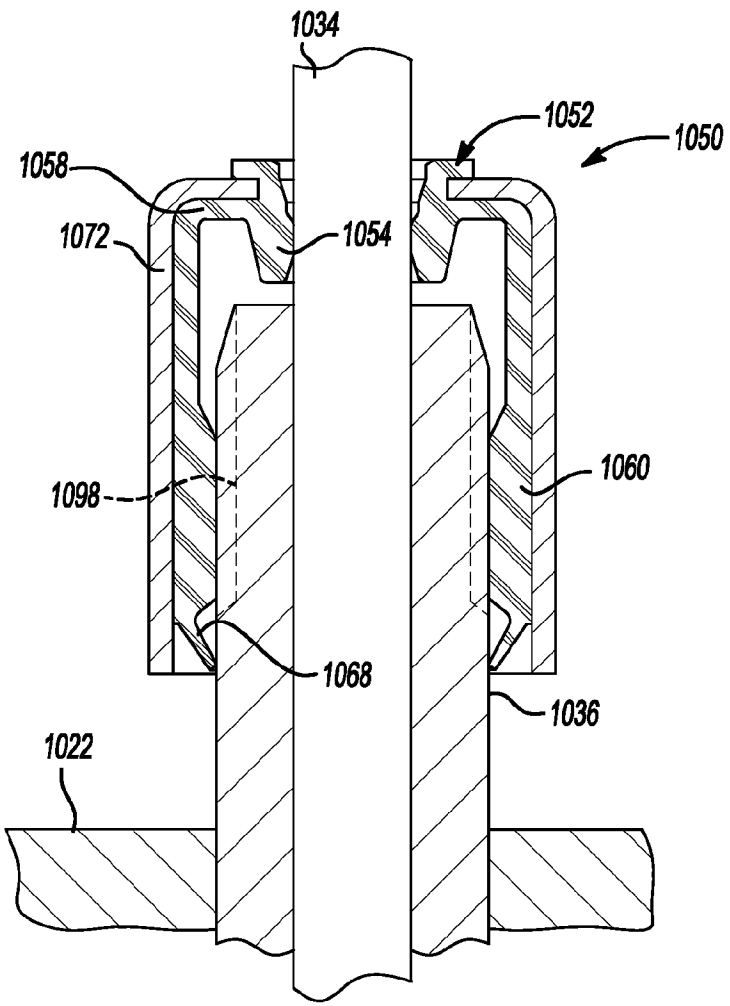
FIG. 14 is a cross-sectional view of another valve stem seal assembly according to the principles of the present disclosure.

Referring to FIG. 14, the valve stem seal assembly 1050 can include a valve guide 1036, a seal component 1052, and a rigid component 1072. Seal component 1052 can be substantially similar to seal component 252 discussed above. However, bottom portion 1060 of seal component 1052 does not include protrusions or channels formed therein. Rigid component 1072 can be substantially similar to rigid component 272 discussed above. Furthermore, valve guide 1036 can be substantially similar to valve guide 936.

Figure 15:
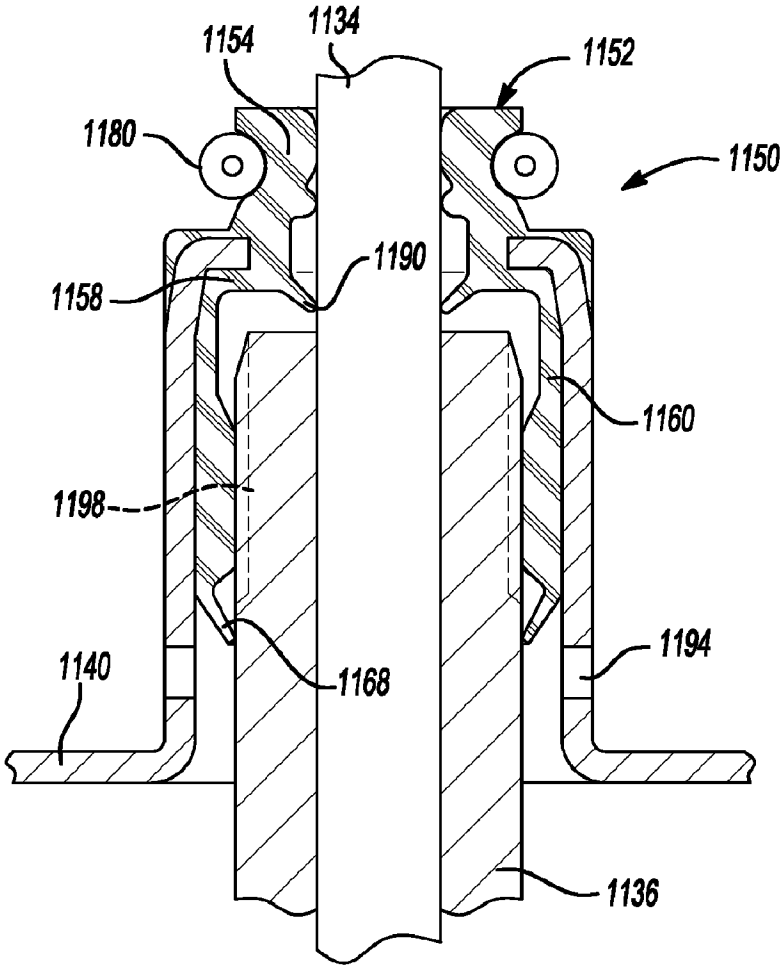
FIG. 15 is a cross-sectional view of another valve stem seal assembly according to the principles of the present disclosure.

Referring to FIG. 15, a valve stem seal assembly 1150 can include a valve guide 1136, a seal component 1152, and a valve spring seat 1140. Seal component 1152 can be substantially similar to seal component 952 discussed above. Valve spring seat 1140 can be substantially similar to valve spring seat 640 discussed above. Furthermore, valve guide 1136 can be substantially similar to valve guide 936 discussed above.

Figure 16:
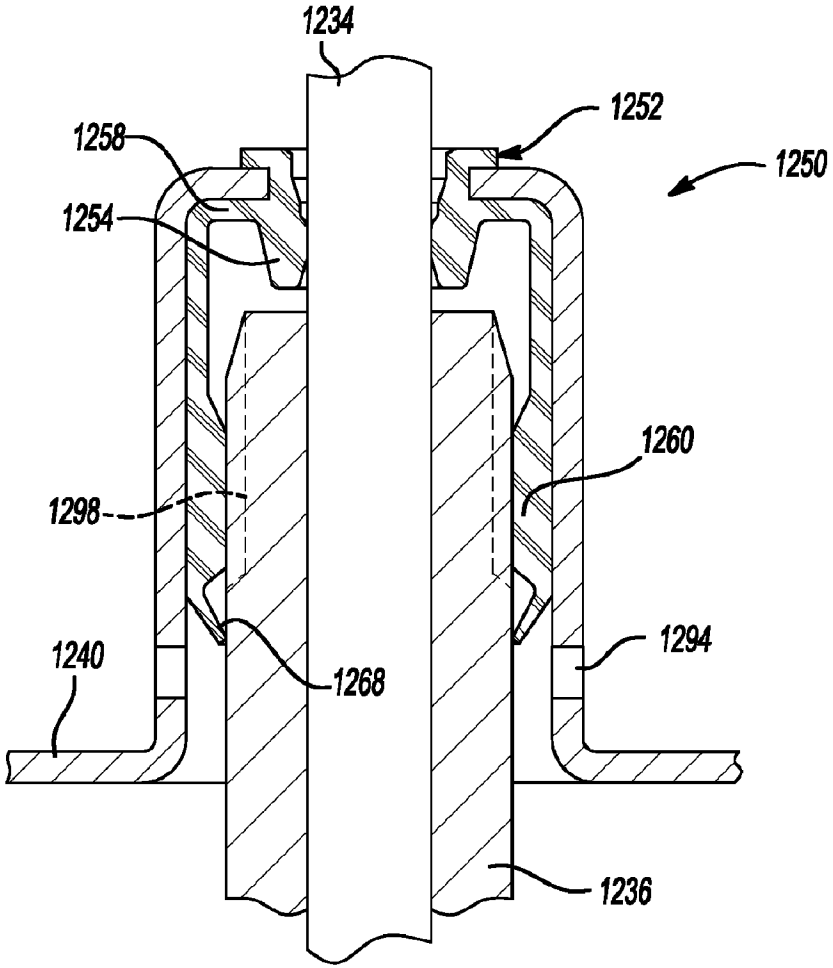
FIG. 16 is a cross-sectional view of another valve stem seal assembly according to the principles of the present disclosure.

Referring to FIG. 16, a valve stem seal assembly 1250 can include a valve guide 1236, a seal component 1252, and a valve spring seat 1240. Seal component 1252 can be substantially similar to seal component 1052 discussed above. Valve spring seat 1240 can be substantially similar to valve spring seat 640 discussed above. Furthermore, valve guide 1236 can be substantially similar to valve guide 936 discussed above.

Figure 17:
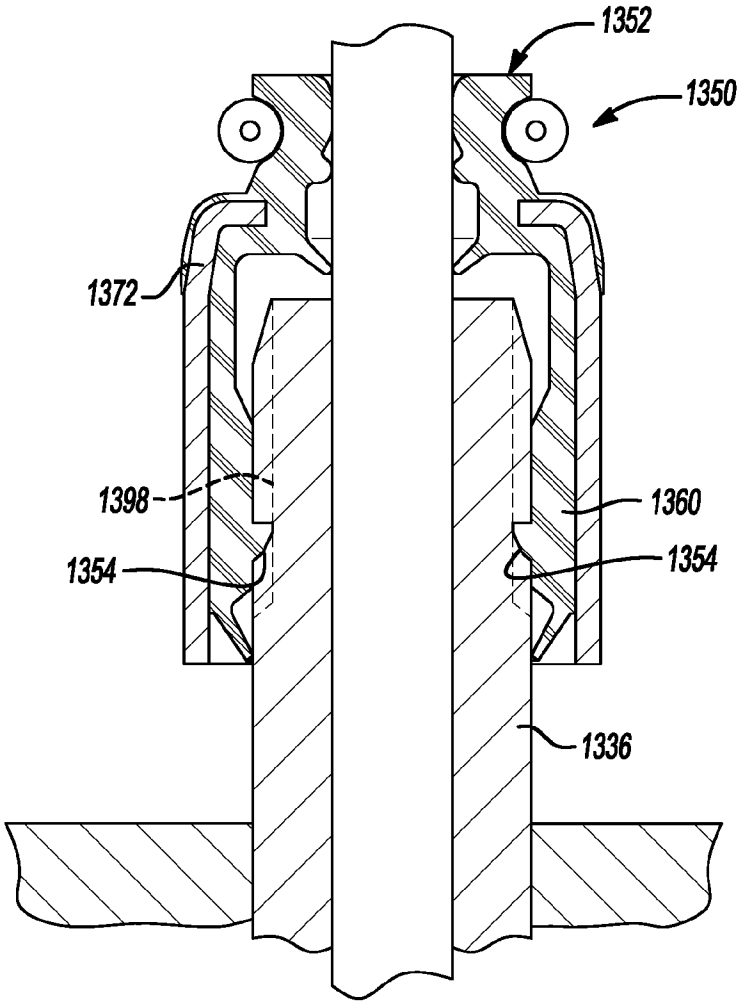
FIG. 17 is a cross-sectional view of another valve stem seal assembly according to the principles of the present disclosure.

Referring to FIG. 17, a valve stem seal assembly 1350 can include a valve guide 1336, a seal component 1352, and a rigid component 1372. Seal component 1352 can be substantially similar to seal component 952 discussed above. However, valve guide 1336 includes retention groove 1354 for reducing the potential for seal pop off, by providing a ridge that the seal forms where the rubber is not compressed at the groove to improve retention. Rigid component 1372 can be substantially similar to rigid component 972 discussed above. Valve guide 1336 can include at least one channel 1398 formed therein. For example, as shown in FIG. 17, valve guide 1336 can have a plurality of channels 1398. With seal component 1352 disposed around valve guide 1336, channels 1398 can provide for gas communication between bottom portion 1360 and valve guide 1336 and, thus, can form part of a passageway in gas communication with a combustion chamber as described above.

Figure 18:
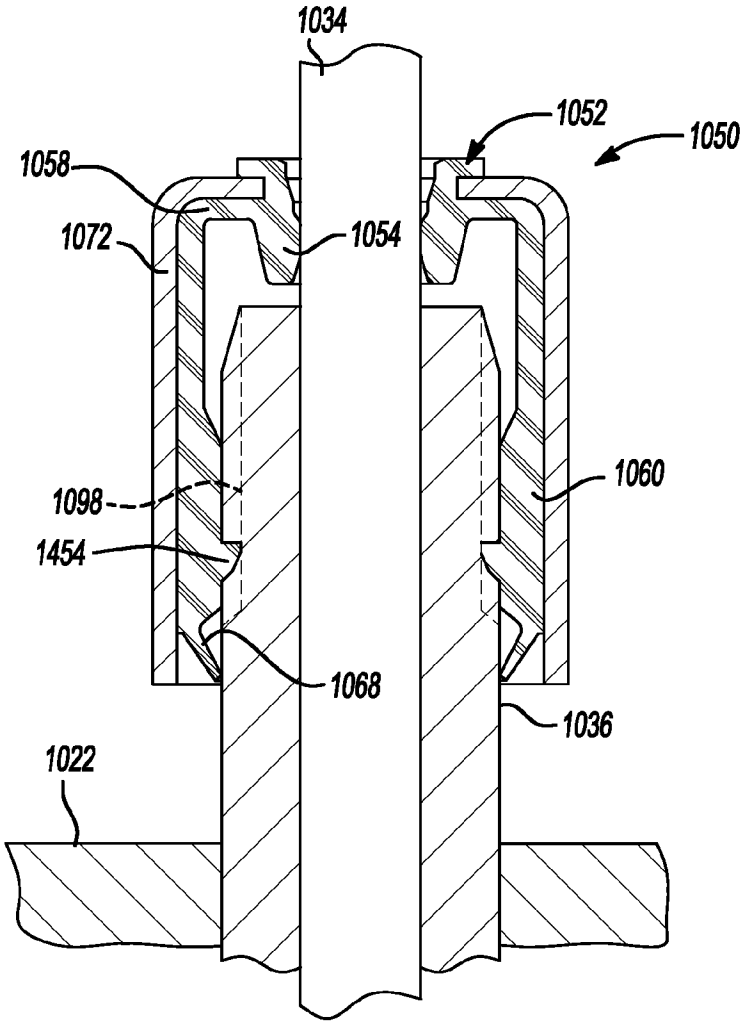
FIG. 18 is a cross-sectional view of another valve stem seal assembly according to the principles of the present disclosure.

Referring to FIG. 18, the valve stem seal assembly 1050 of FIG. 14 is shown with a retention groove 1454 provided in the valve guide 1036.

Figure 20:
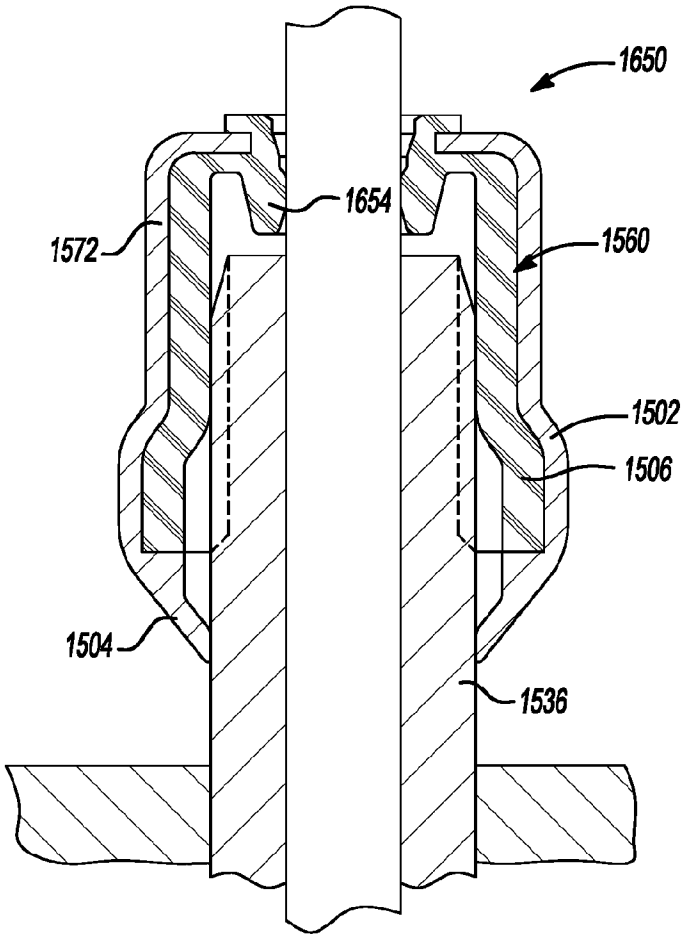
FIG. 20 is a cross-sectional view of another valve stem seal assembly according to the principles of the present disclosure.
Figure 19:
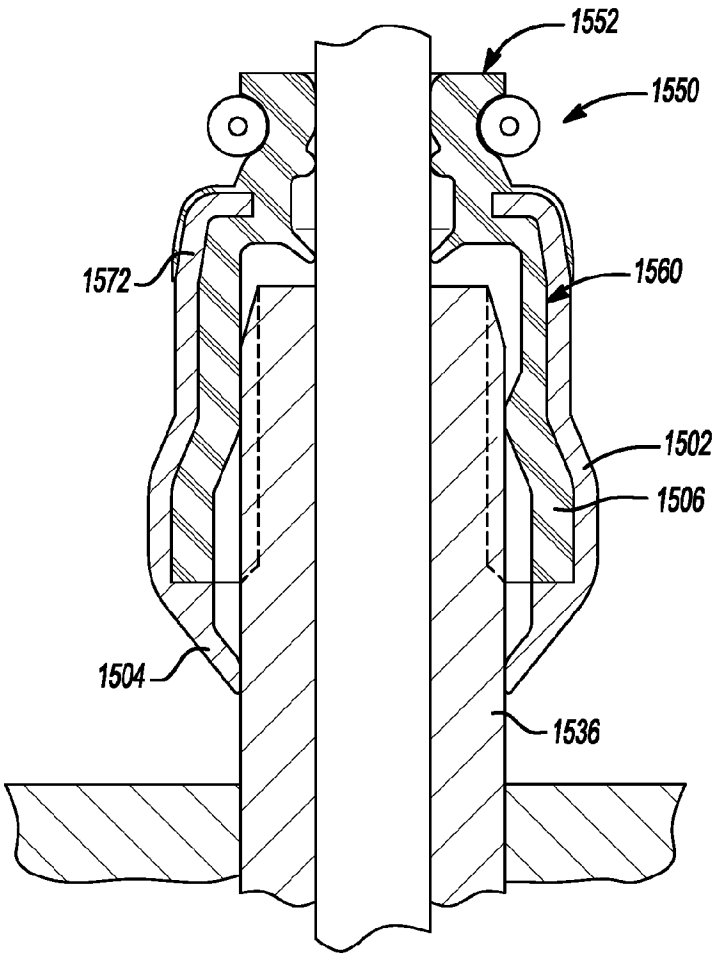
FIG. 19 is a cross-sectional view of another valve stem seal assembly according to the principles of the present disclosure.

Referring to FIG. 19, a valve stem seal assembly 1550 can include a valve guide 1536, a seal component 1552, and a rigid component 1572. The rigid component 1572 includes a radially outwardly stepped portion 1502 and supporting a radially inwardly extending distal end portion 1504 as the pressure relief lip in contact with the surface of the valve guide. The seal component 1552 includes a bottom portion 1560 that has a radially outwardly stepped portion 1506 corresponding to the outwardly stepped portion 1502 of the rigid component 1572. The outwardly step portion 1502 provides a valve spring pilot to assist centering of the valve spring, and creates a larger radial space for optional vent lip configurations for increase tuning of the opening pressure of the lip. As shown in FIG. 20, the rigid component 1572 with a outwardly stepped portion 1502 stepped portion and a supported radially inwardly extending distal end portion 1504 contacting the valve guide 1536 is shown incorporated with a seal component 1650 having an inverted top portion 1654. The outwardly step portion 1502 provides a valve spring pilot to assist centering of the valve spring, and creates a larger radial space for optional vent lip configurations for increase tuning of the opening pressure of the lip. The cavity created radially inward by the step portion 1502 allows oil to pool above the vent lip which assists sealing any vacuum pressure that may exist outside the vent lip. The pool of oil acts as a barrier to the vacuum pressure but will release the oil when a positive pressure in the cavity occurs, thereby allowing the vent lip to release positive pressure while sealing against a possible vacuum pressure.

The present disclosure can vary in many ways. A valve stem seal assembly or a seal component according to the principles of the present disclosure can be used in a variety of applications including, but not limited to, providing a fluid seal between a lubrication or oil chamber and a combustion chamber of an internal combustion engine. Furthermore, a seal component of a valve stem seal assembly according to the present disclosure can have a variety of configurations. It is to be appreciated that a seal component and a valve stem seal assembly according to the present disclosure are not limited to the embodiments disclosed herein. As such, a valve stem seal assembly according to the principles of the present disclosure can include a variety of combinations to the components and features disclosed herein. Additionally, other components of a valve stem seal assembly can also vary, and a valve stem seal assembly can also include additional components. For example, valve stem seal assembly can include further retaining members to help maintain the position of seal components. Additionally, the components of valve stem seal assemblies can be made of a variety of materials.

What is claimed is:

1. A valve stem seal for an internal combustion engine, the valve stem seal comprising:

an annular elastomeric body disposed around a valve stem and a valve guide for the engine, said elastomeric body including a first portion having a sealed engagement with the valve stem, a second portion extending around the valve guide, a connecting portion extending radially outwardly from said first portion to said second portion, and a pressure relief lip extending from said second portion, said connecting portion adapted to be axially spaced apart from an upper end of said valve guide, said pressure relief lip having a sealing configuration and a venting configuration, said sealing configuration adapted to close a passageway in fluid communication with a combustion chamber of the engine to a lubrication chamber of the engine, said venting configuration adapted to open the passageway to the lubrication chamber, said second portion including a plurality of spaced apart axially extending protrusions extending radially inward from an inner surface thereof and adapted to engage the valve guide and a plurality of axially extending channels discretely formed between the inner surface and a pair of adjacent protrusions of the plurality of axially extending protrusions, each channel adapted to form part of the passageway and spaced circumferentially around the inner surface of said second portion such that each channel is adapted to directly face said valve guide;

wherein said pressure relief lip is operable to open to said venting configuration at a predetermined pressure within the passageway and the combustion chamber to allow excess exhaust gases to vent from the passageway and the combustion chamber, and said pressure relief lip is operable to close to said sealing configuration after the venting of the excess exhaust gases to prevent fluid from the lubrication chamber from entering the passageway and the combustion chamber.

2. The valve stem seal of claim 1, wherein said connecting portion of said elastomeric body extends from a bottom part of said first portion of said elastomeric body, and said second portion of said elastomeric body extends axially away from said first portion.

3. The valve stem seal of claim 2, wherein said elastomeric body further includes a gas lip extending from said bottom part of said first portion and adapted to have a sealed engagement with the valve stem.

4. The valve stem seal of claim 1, wherein said connecting portion of said elastomeric body extends from a top part of said first portion of said elastomeric body, and said second portion of said elastomeric body is adapted to extend around said first portion and the valve guide.

5. The valve stem seal of claim 4, wherein said elastomeric body further includes a flange extending axially away from said connecting portion, said flange defining a lubrication fluid trap adapted to extend around the valve stem and provide lubrication fluid to the valve stem.

6. The valve stem seal of claim 1, wherein said pressure relief lip of said elastomeric body extends radially inwardly from an end of said second portion of said elastomeric body opposite said first portion of said elastomeric body, such that a free end of said pressure relief lip includes a smaller inner diameter than an opposite end connected to said second portion in said sealing configuration.

7. The valve stem seal of claim 1, wherein said pressure relief lip of said elastomeric body is adapted to have a sealed engagement with an outer surface of the valve guide in said sealing configuration.

8. The valve stem seal of claim 1, wherein said second portion of said elastomeric body is adapted to be disposed directly on the valve guide.

9. A valve stem seal assembly for an internal combustion engine, the engine including a housing separating a lubrication chamber and a combustion chamber, a valve guide fixed in the housing, and a valve stem extending through the valve guide and housing between the lubrication chamber and the combustion chamber, the valve stem seal assembly comprising:

an annular rigid body and an annular elastomeric body both disposed around the valve guide and the valve stem, said elastomeric body including a first portion having a sealed engagement with the valve stem, a second portion extending around the valve guide, a connecting portion extending radially outwardly from said first portion to said second portion, and a pressure relief lip extending from said second portion, said second portion including a plurality of spaced apart axially extending protrusions extending radially inward from an inner surface thereof and adapted to engage the valve guide and a plurality of axially extending channels discretely formed between the inner surface and a pair of adjacent protrusions of the plurality of axially extending protrusions, each channel forming part of the passageway and spaced apart circumferentially around the inner surface of said second portion such that each channel is adapted to directly face said valve guide, said pressure relief lip having a sealing configuration and a venting configuration, said sealing configuration adapted to close a passageway in fluid communication with the combustion chamber to the lubrication chamber, said venting configuration adapted to open the passageway to the lubrication chamber, said pressure relief lip extending radially inward from said second portion such that a free end of said pressure relief lip has a smaller inner diameter than an opposite end connected to said second portion in said sealing configuration;

wherein said pressure relief lip is operable to open to said venting configuration at a predetermined pressure within the passageway and the combustion chamber to allow excess exhaust gases to vent from the passageway and the combustion chamber, and said pressure relief lip is operable to close to said sealing configuration after the venting of the excess exhaust gases to prevent fluid from the lubrication chamber from entering the passageway and the combustion chamber.

10. The valve stem seal assembly of claim 9, wherein said second portion of said elastomeric body is adapted to be disposed between the valve guide and said rigid body.

11. A valve stem seal assembly for an internal combustion engine, the engine including a housing separating a lubrication chamber and a combustion chamber, the valve stem seal assembly comprising:

a valve guide fixed in the housing and extending between the lubrication chamber and the combustion chamber;

a valve stem extending through said valve guide between the lubrication chamber and the combustion chamber; and an annular rigid body and an annular elastomeric body both disposed around said valve guide and said valve stem, said elastomeric body including a first portion having a sealed engagement with said valve stem, a second portion extending around said valve guide, a connecting portion extending radially outwardly from said first portion to said second portion and spaced axially apart from an upper surface of said valve guide, and a pressure relief lip extending from said second portion, said pressure relief lip having a sealing configuration and a venting configuration, said sealing configuration adapted to close a passageway in fluid communication with the combustion chamber to the lubrication chamber, said venting configuration adapted to open the passageway to the lubrication chamber, said second portion including a plurality of axially extending protrusions extending radially inward from an inner surface thereof and spaced apart circumferentially around the inner surface and a plurality of axially extending channels discretely formed between the inner surface and a pair of adjacent protrusions of the plurality of axially extending protrusions, each channel forming part of the passageway and spaced circumferentially around the inner surface such that each channel directly faces said valve guide, said pressure relief lip extending radially inward from said second portion such that a free end of said pressure relief lip has a smaller inner diameter than an opposite end connected to said second portion in said sealing configuration;

wherein said pressure relief lip is operable to open to said venting configuration at a predetermined pressure within the passageway and the combustion chamber to allow excess exhaust fluids to vent from the passageway and the combustion chamber, and said pressure relief lip is operable to close to said sealing configuration after the venting of the excess exhaust fluids to prevent fluid from the lubrication chamber from entering the passageway and the combustion chamber.

12. The valve stem seal assembly of claim 11, wherein said passageway is formed in part by said axially extending channels and a radially extending passage formed between an upper end of said valve guide and a spaced apart surface of said connecting portion of said elastomeric body.

* * * * *